US006598652B1

(12) United States Patent
Montesinos Alonso

(10) Patent No.: US 6,598,652 B1
(45) Date of Patent: Jul. 29, 2003

(54) DISTANCE-CONTROLLED ELECTRICALLY POWERED UNIT FOR ACTUATING RAIL-MOUNTED CURTAINS

(75) Inventor: Vicente Montesinos Alonso, Valencia (ES)

(73) Assignee: C.A.S. Locks S.L., Xirivella (ES)

( * ) Notice: Subject to any disclaimer, the term of this patent is extended or adjusted under 35 U.S.C. 154(b) by 0 days.

(21) Appl. No.: 09/719,763

(22) PCT Filed: Jun. 17, 1999

(86) PCT No.: PCT/ES99/00180

§ 371 (c)(1),
(2), (4) Date: Dec. 15, 2000

(87) PCT Pub. No.: WO99/65372

PCT Pub. Date: Dec. 23, 1999

(30) Foreign Application Priority Data

Jun. 17, 1998 (ES) ..... 9801274

(51) Int. Cl.[7] ..... A47H 1/00
(52) U.S. Cl. ..... 160/331; 160/320
(58) Field of Search ..... 160/320, 321, 160/310, 331, 344

(56) References Cited

U.S. PATENT DOCUMENTS

| | | | | |
|---|---|---|---|---|
| 2,468,453 | A | * | 4/1949 | Mallentjer |
| 2,875,981 | A | | 3/1959 | Hunter |
| 3,096,078 | A | * | 7/1963 | Steingass et al. |
| 3,269,454 | A | | 8/1966 | Gill et al. |
| 3,878,877 | A | * | 4/1975 | Bruneau et al. |
| 4,850,415 | A | * | 7/1989 | Rometsch |
| 4,958,112 | A | | 9/1990 | Zerillo |
| 5,134,347 | A | | 7/1992 | Koleda |
| 5,270,629 | A | * | 12/1993 | Hsieh |
| 5,315,218 | A | | 5/1994 | Fortune et al. |
| 5,444,339 | A | | 8/1995 | Domel et al. |
| 5,495,153 | A | | 2/1996 | Domel et al. |
| 5,793,174 | A | * | 8/1998 | Kovach et al. |
| 5,889,377 | A | * | 3/1999 | Mao |

FOREIGN PATENT DOCUMENTS

| | | |
|---|---|---|
| AT | 301089 | 8/1972 |
| EP | 0482252 | 4/1992 |
| WO | WO9518317 | 7/1995 |

* cited by examiner

*Primary Examiner*—Blair M. Johnson
(74) *Attorney, Agent, or Firm*—Richard M. Goldberg

(57) ABSTRACT

A motor-driven unit that can be remotely controlled for moving a curtain fitted on a rail and having an operation cord, includes an electrical power supply, a reversible motor, pulleys suspended on the operation cord with the operation cord being partially housed in a channel over at least part of a perimeter of the pulleys and in such a way that the weight of the unit maintains cohesion between the operation cord and the pulleys, and being enough to compensate for friction exerted by the curtain or the rail itself, the channel having a convergent cross-section, a mass which keeps the operating cord taught, a signal receiver, a remote control for generating a signal for determining movement of the motor in either direction and supplied to the signal receiver, and the mass and electrical supply together formed by an electrical accumulator.

12 Claims, 4 Drawing Sheets

FIG.2
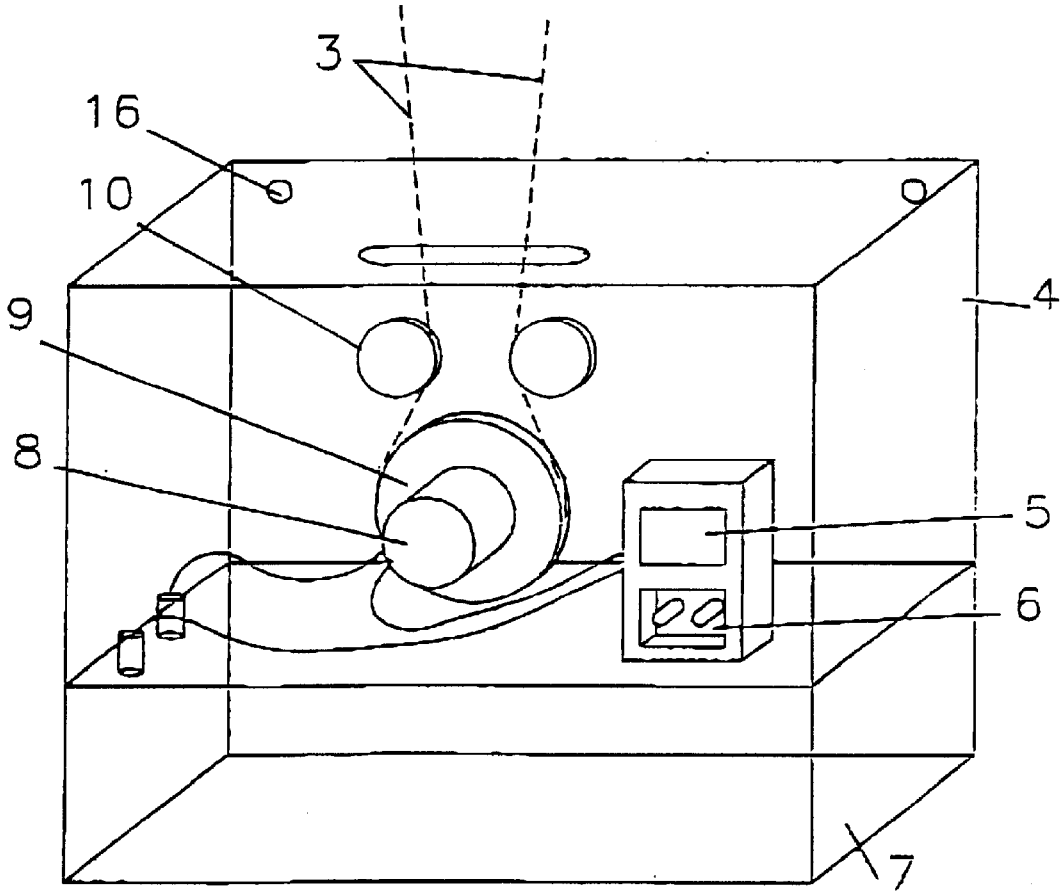
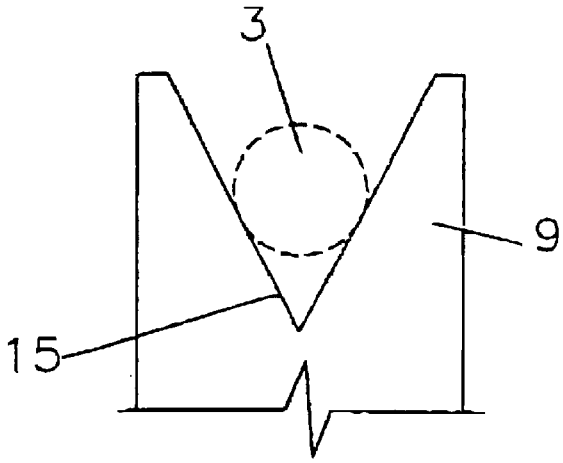
FIG.3

DISTANCE-CONTROLLED ELECTRICALLY POWERED UNIT FOR ACTUATING RAIL-MOUNTED CURTAINS

BACKGROUND OF THE INVENTION

The technical sector involved in this patent is that of motor-driven curtains, and mainly that of household curtains of the type that are installed on rails and of the type that move along the corresponding rail, in which the rail is fitted with endless cords, so that the movement of the cord does not alter its double length, which only moves in accordance with the curtain movement.

Fixed systems for curtain-driving are available on the market. These require connection to the electricity supply, a special rail and a system for driving them. They work out expensive, and especially difficult to arrange due to the great variety of possibilities and types of curtain that can be fitted.

There are diverse patents for operating blinds or shutters which consists of small simply-secured devices, amongst which we could mention:

U.S. Pat. No. 76,556 (EP0702855) discloses mini-blind operation system, consisting of a motor and a housing which sustains the motor and the battery, with the motor being coupled to the drive rod of a slat shutter, and with a selector driving the movement or opening of the slats by means of a light pick-up inside the corresponding room, or by means of a remote control operated by the user.

EP0482252, for a control device for Venetian blinds and curtains, consists of an infrared remote control device for Venetians blinds and curtains, which includes a housing in which two motors are mounted, one of these having an axle with a wheel and slot in this to pull a cord and the other having an extended axle with a wheel to pull the cord with a slot and a ball chain wheel. This has a pair of pressure rollers located at the ends of the plates with two springs, mounted through the plates so that the pressure rollers are forced towards the slots the slots of the wheels which guide the cords to press on the wheels valid for different thicknesses of cords. It has a sensor to operate the curtain or Venetian blind by means of remote control.

U.S. Pat. No. 27,836 (EP0615081) for control by two or more electrical motors, constitutes a complex mechanism for curtain operation.

U.S. Pat. No. 4,958,112 consists of a device for operation of curtain rails, provided with an electric motor and a pulley which moves the cord, the device being fixed to the wall and the cord requiring two stops placed at predetermined positions at the cord. It works through a remote control device which allows opening or closing the curtain, but does not allow to stop it at any desired position, and the device is not autonomous, since it must be fixed to the wall.

AT 301089 consists of a device for operating curtain cords which is held on the cord lower loop by means of a pulley. It comprises an electric motor, means for electric feeding such as a plug and a transformer, and an operation device provided with wires. The extreme positions of the curtain are determined by stops. This device is not autonomous since it requires the proximity of a plug for plugging the device. Furthermore the remote control system disclosed is by means of a wire.

SUMMARY OF THE INVENTION

This invention covers a motor-driven unit that can be remotely operated for moving curtains or similar fitted on rails, which is installed by simply hanging this from the curtain, and which can possibly be secured to the corresponding wall, which does not require any installation, and which has an integrated load means, with a set of pulling and pushing rollers arranged so as to form a self-adjustable clutch.

A system for energy-saving it also included is the design, by means of which, since this is a motor-driven unit which is basically independent, it solves the problem of the relatively high consumption of the remote control receives, which can use up the battery in a short time, even when not being used.

The motor-driven unit which constitutes this invention has a circuit which includes a power-saving system which solves said problem with the electricity consumption.

BRIEF DESCRIPTION OF THE DRAWINGS

In order to make the explanation to follow clearer, four sheets of drawings are adjoined, representing the essence of this invention in five figures.

FIG. 2 shows a diagram view of the motor with its power supply battery.

FIG. 3 shows a cross-section detail of the main pulley for driving the curtain.

DETAILED DESCRIPTION

Figure 1:
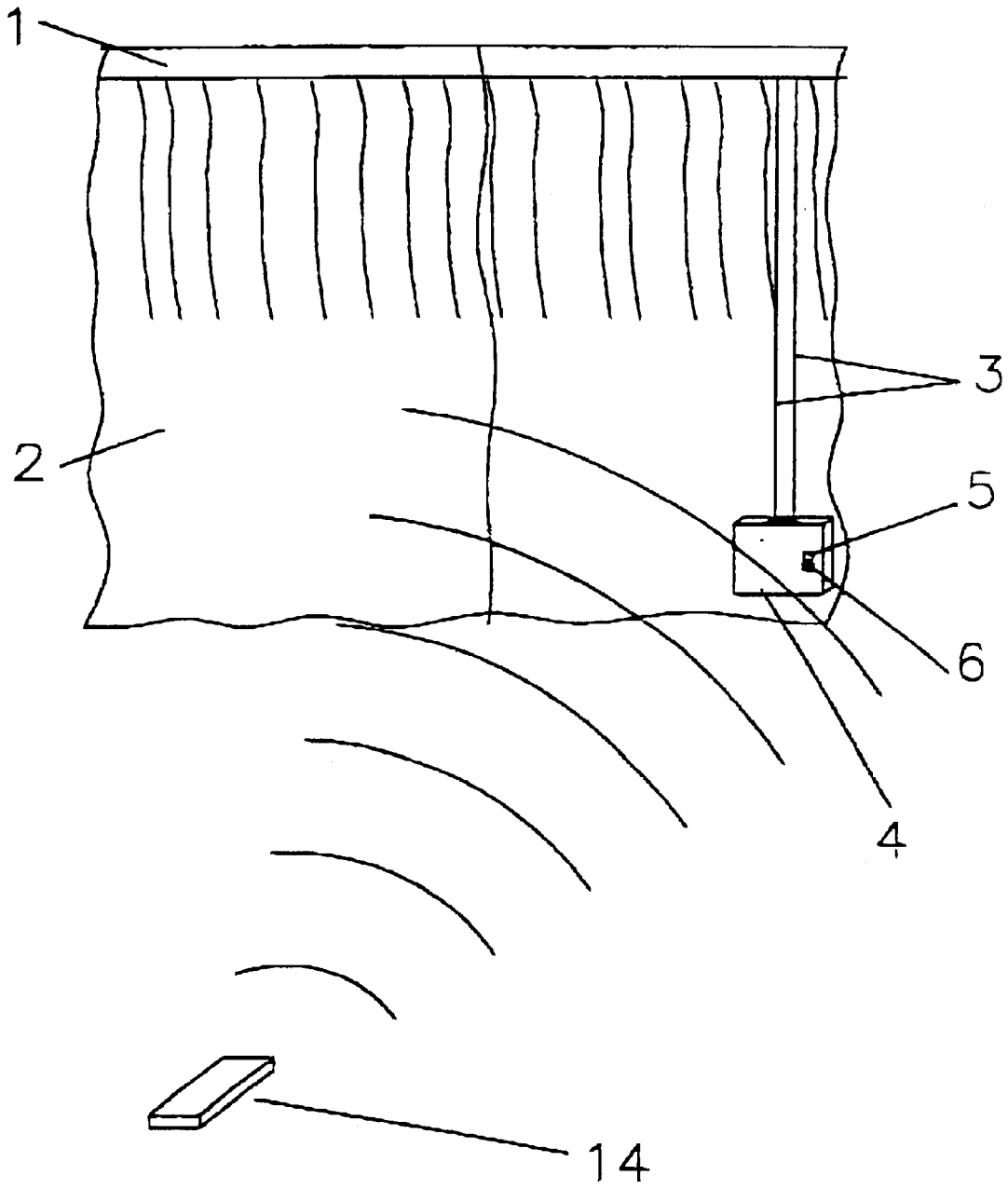
FIG. 1 shows a view of the motor and remote control assembly in the corresponding example system.
Figure 4:
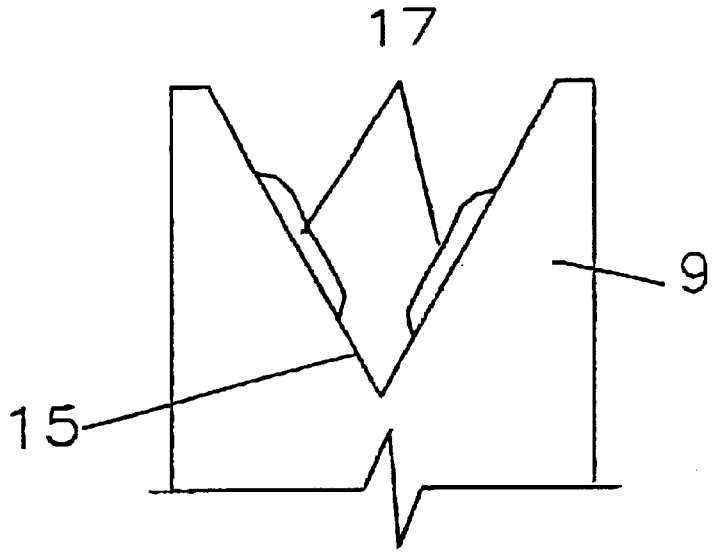
FIG. 4 shows a view of an embodiment of the pulley with projections in which the cord for operating the curtain winds around said projections.
Figure 5:
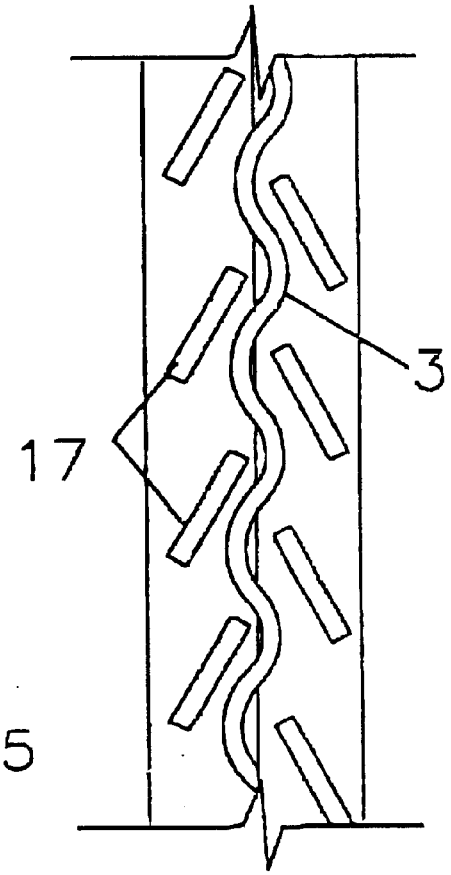
FIG. 5 shows a diagram view of part of the development of said pulley.
Figure 6:
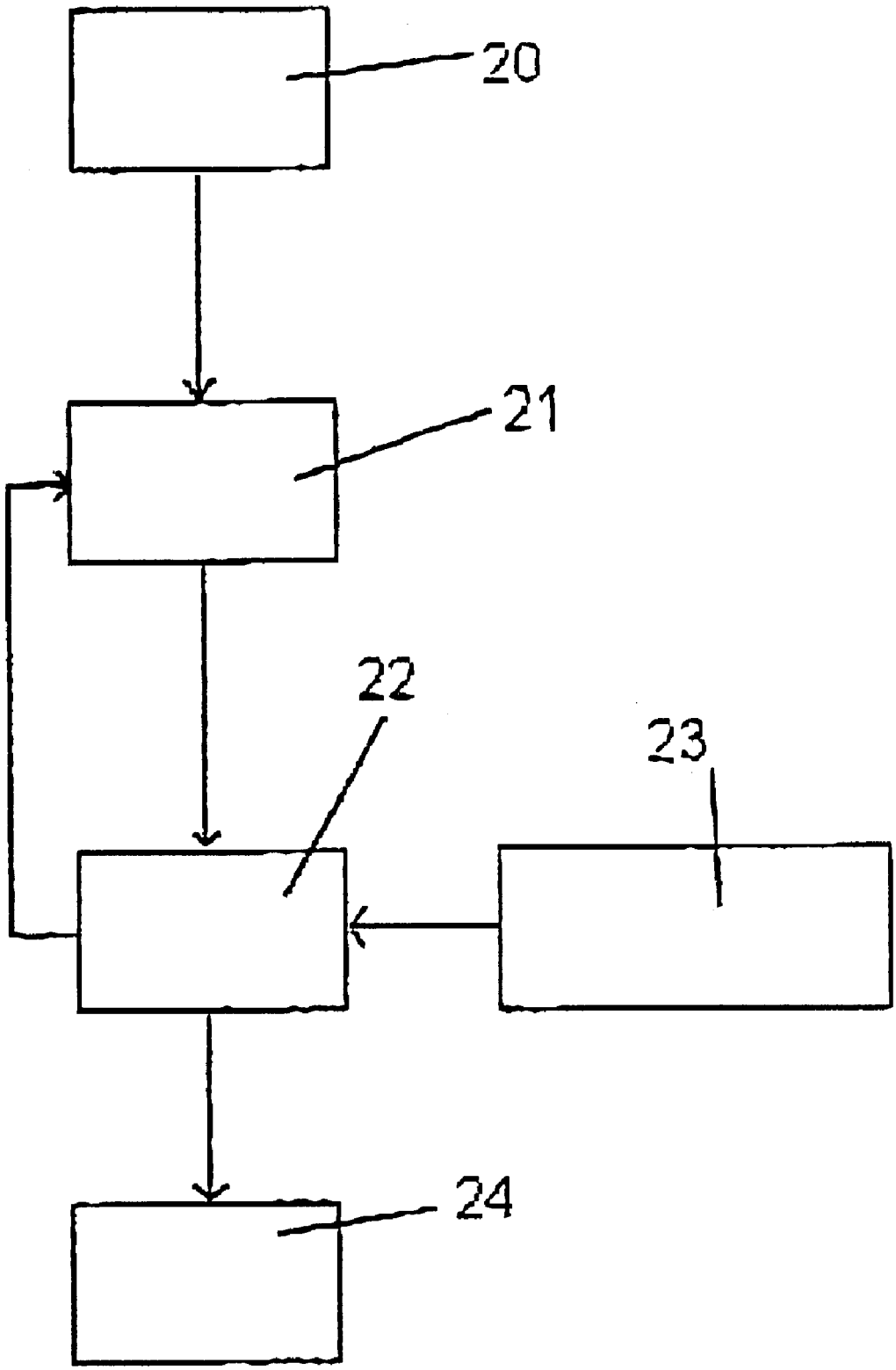
FIG. 6 shows a block diagram of the electronic circuit.

In said FIGS. 1 represents the rail from which the curtain hangs, 2 the curtain strictly speaking, 3 the cords for operating the curtain, 4 the motor casing, 5 being the sensor for the remote control, 6 the socket for charging, 7 the battery, 8 the motor, 9 the main pulley, 10 the secondary pulleys, 14 the remote control, 15 the inside profile of the pulley formed by a V-shaped channel or internal perimeter, 16 being the holes for optionally fixing the assembly to the wall, 17 being the projections set out alternately inside the pulley, although the layout shown in the drawing is not established as a necessary form.

As for the block diagram, 20 indicates the clock, 21 the signal receiver, 22 the main controller, 23 the programming and 24 the motor controller.

In accordance with the diagrammatic description of this given above, this invention consists of an assembly formed of a motor with a battery providing it with power and operative capacity for a time. Said assembly does not require any installation, instead being fitted simply by literally hanging the motor assembly casing 4 from the cords or ball cords, hereinafter indicated only as operating cords for the curtain 3, being available for continuous use. This assembly has a socket 6 for charging, which by means of a cable of the right length is connected to a nearby mains socket, to be charged in a few hours, then being removed after said process. The equipment is autonomous for this reason, and given the scanty use even in cases of intensive operation, as well as the capacity of the battery 7, such charging means provides that the assembly has a long operative duration.

Since the assembly covered by this description is not connected to the network nor requires installation, it has a current input so that the internal charger can carry out the charging process by means of connection with a cable specifically used for this time. This entails the possibility that the motor-driven unit need only be hung from the cords which it drives, being to be secured by means of the corresponding holes provided in the rear of its body. Also, given the weight of the battery along with the mechanical assembly, it is not even necessary to install the unit except for hanging this from the curtain-operating cords.

The main pulley 9 consists of a deep V-shaped profile, in such a way that the tension of the traction on the operating cord determines the cohesion by pressure of said cord, which tends to press against the bottom. All of this does not prevent the form of said pulley from constituting a self-adjustable clutch, when reaching the end of the travel, so that this slips without the traction damaging either the cord or the pulley, and without losing any pulling characteristics.

The main pulley can be fitted with projections 17 between which the cords for operating the curtain are housed in a zigzag or winding pattern, thus determining the optimum securing of the cord to the pulley. Since the pulley cannot fulfil the function of automatic clutch in this case, electronic sensors have been envisaged to determine a predetermined end of stroke position and consequently stop the motor.

One form of embodiment stems from the explanation of the invention as given above.

The protection requested is to be made material in a motor-driven unit that can be remotely controlled for moving curtains fitted on a rails, characterised in that this includes the unit strictly speaking consisting of:

Means of electrical power supply;

A motor or reduction motor with reversible operation 8;

Means for receiving a signal 5;

A remote control 14 generating a signal in such a way that the movement of the motor in one direction or the other is determined by the order given by the remote control, whose signal is received by the means for receiving the signal;

At least one pulley 9;

with said unit 4 being able to be suspended on the cord 3 for curtain operation, so that said cord 3 is partially housing over at least one part of the perimeter 15 of the pulley 9, and so that the weight of the unit 4 tends to maintain cohesion the cord 3 and the pulley 9, this weight being enough to compensate for the friction exerted by the curtain or the rail itself;

A mass able to keep the operation cord taut, said mass being able to consist of a battery or electrical accumulator;

having a current socket 6 for connection to the mains by means of a temporary or permanent connection cable;

and having a set of pulleys consisting of a main pulley 9 and secondary pulleys, in which the main pulley is fitted with a channel or internal perimeter 15 in which the curtain operating cord 3 is partially housed and fitted, with said channel having a V-shape when seen in cross-section, and whose internal pulley section may possibly be provided with projections 17 alternately arranged on each side of its internal perimeter, which determine a winding or zigzag fastening of the curtain cords in the slot in said pulley, in which there are preferably two secondary pulleys, whose axles are on a plane higher than the main one, and arranged symmetrically in respect of this, with said pulleys receiving the cords through the centre between these, in which the proximity between the secondary pulleys determines the part of the perimeter in which the cord makes contact with the main pulley 9, and in which there are limit switch sensors for cutting off the power supply to the motor.

The energy-saving system consists of a circuit which includes a clock 20 which informs the circuit of time pulses, combined with a receiver for the signal from the remote control 21. The receiver 21 is permanently operated by the main controller, which acts on the receiver through the previously programmed clock signal. The system works by the main controller, acting according to pre-set cycles, controlling the opening of the reception for a short space of time in each cycle, by means of said circuit. This time could for example be one millisecond every one thousand milliseconds, which means that the circuit is active for 1/1000of the time which would correspond to the permanently activated circuit. Consequently, after receiving the signal in the circuit, the motor controller 24 will be activated through the corresponding programming, which coordinates a signal from a remote control with said receiver 21, therefore meaning that the remote controls can have several control functions over different curtains.

The aforementioned assembly is fully valid for moving the functions of blinds, Venetian blinds or slat blinds to the extent in which operating cords have to be activated to exert said movement.

This invention is for industrial application in manufacturing motors for remotely driving curtains hung from rails.

What is claimed is:

1. A motor-driven unit that can be remotely controlled for moving a curtain or similar items fitted on a rail and having an operation cord, comprising:

an electrical power supply, a motor with a reversible operation, at least one pulley by which the unit can be suspended on the operation cord for a curtain moving operation, without being secured to the wall, such that the operation cord is partially housed over at least part of a perimeter of the at least one pulley and in such a way that the weight of the unit tends to maintain cohesion between the operation cord and the at least one pulley, this weight being enough to compensate for friction exerted by the curtain or the rail itself, and the pulley being provided with the a channel along which the operation cord for operating the curtain is partially housed, said channel having a convergent cross-section, a mass which, when held on the operation cord, keeps said operating cord taut, a signal receiver, a remote control for generating a signal in such a way that movement of the motor in one direction or the other is determined by an order of receipt of a signal from the remote control by the signal receiver, and the mass which keeps the operation cord taut and the electrical supply together being comprised of a battery which forms a substantial part of the mass of the motor-driven unit, and an electrical circuit for reception and operation of signals received from the remote control, said electronic circuit including:

said signal receiver, an energy-saving circuit which includes a clock circuit that provides timing cycles, a program circuit, a motor control circuit which controls the motor, and a main controller which acts through the program circuit to control the motor control and which opens reception of said signal receiver for a short space of time in each timing cycle.

2. A motor-driven unit according to claim 1, further comprising a charging circuit for charging the electrical power supply.

3. A motor-driven unit according to claim 2, wherein said charging circuit includes a current socket for connection to a main power source by means of a connection cable for charging the electrical power supply.

4. A motor-driven unit according to claim 1, wherein said at least one pulley includes a main pulley and secondary pulleys.

5. A motor-driven unit according to claim 4, wherein the channel of the main pulley includes a projections alternately arranged on each side of an internal perimeter thereof, determining a winding fastening of the curtain cords in the slot of said at least one pulley.

6. A motor-driven unit according to claim 4, wherein a proximity between the secondary pulleys determines a section of the perimeter along which the cord makes contact with the main pulley.

7. A motor-driven unit according to claim 1, further comprising limit switch sensors for cutting off the electrical power supply to the motor.

8. A motor-driven unit according to claim 1, wherein said motor is a reduction motor.

9. A motor-driven unit according to claim 1, wherein said channel has a V-shaped cross-section.

10. A motor-driven unit according to claim 5, wherein said winding fastening is a zig-zag fastening.

11. A method of moving a curtain or similar items fitted on a rail and having an operation cord, by remote control of a motor-driven unit, comprising the steps of:

suspending a motor-driven unit by at least one pulley thereof having a channel on the operation cord, without securing the motor-driven unit to a wall, the motor-driven unit including a motor with a reversible operation, providing a battery in the motor-driven unit to supply operating power to the motor, providing that the battery forms a substantial part of the mass of the motor-driven unit, maintaining the operation cord taut and maintaining cohesion between the operation cord and the at least one pulley, by the mass of the suspended motor-driven unit of which the battery forms a substantial part, activating a remote control to generate a signal received by a signal receiver of the motor-driven unit in such a way that movement of the motor in one direction or the other is determined by an order of receipt of the signal from the remote control by the signal receiver.

12. A method according to claim 11, further comprising the step of controlling said signal receiver for a short space of time in a timing cycle to receive the generated signal.

* * * * *